US009346651B2

(12) United States Patent
Ludwig et al.

(10) Patent No.: US 9,346,651 B2
(45) Date of Patent: May 24, 2016

(54) WINDING MACHINE

(71) Applicant: Georg Sahm GmbH & Co. KG, Eschwege (DE)

(72) Inventors: Markus Ludwig, Eschwege (DE); Matthias Hollstein, Meissner (DE)

(73) Assignee: GEORG SAHM GMBH & CO. KG, Eschwege (DE)

( * ) Notice: Subject to any disclaimer, the term of this patent is extended or adjusted under 35 U.S.C. 154(b) by 212 days.

(21) Appl. No.: 13/957,787

(22) Filed: Aug. 2, 2013

(65) Prior Publication Data

US 2013/0313354 A1 Nov. 28, 2013

Related U.S. Application Data

(63) Continuation of application No. PCT/EP2012/051215, filed on Jan. 26, 2012.

(30) Foreign Application Priority Data

Feb. 9, 2011 (DE) ..... 10 2011 000 590

(51) Int. Cl.
*B65H 19/22* (2006.01)
*B65H 67/04* (2006.01)
*B65H 19/30* (2006.01)

(52) U.S. Cl.
CPC ..... *B65H 67/0411* (2013.01); *B65H 19/30* (2013.01); *B65H 2301/4187* (2013.01); *B65H 2301/41856* (2013.01); *B65H 2408/23152* (2013.01)

(58) Field of Classification Search
CPC ..... B65H 19/30; B65H 67/411; B65H 2301/4187
USPC ..... 242/555.3, 555.5, 559, 559.2, 533, 242/533.2, 533.4–533.5
See application file for complete search history.

(56) References Cited

U.S. PATENT DOCUMENTS 3,921,922 A 11/1975 Wuest
3,964,723 A * 6/1976 Schippers et al. ..... 242/473.5
(Continued)

FOREIGN PATENT DOCUMENTS

CN 101395079 A 3/2012
DE 195 05 838 A1 9/1995
(Continued)

OTHER PUBLICATIONS

PCT Search Report in co-pending related PCT Application No. PCT/EP2012/051215, mailed Aug. 30, 2013.
(Continued)

*Primary Examiner* — Sang Kim
(74) *Attorney, Agent, or Firm* — Thomas | Horstemeyer, LLP

(57) ABSTRACT

The invention relates to a winding machine, on which, in alternation, a wound package is wound in a winding position of a spindle, while at the same time a completely wound package is removed from another spindle. With winding machines according to the prior art, the completely wound package must be removed quickly before the other wound package has reached a critical diameter to avoid a collision of their lateral faces. According to the invention, a shifting device shifts the completely wound package before or during the winding process of the wound package such that the axial extensions of the wound packages have no overlap. The collision of the wound packages can thus be prevented as the diameter of the wound package increases, whereby a more compact design with a smaller spacing of the spindles is made possible and an operator has more time to remove the completely wound spool.

22 Claims, 5 Drawing Sheets

(56) References Cited

U.S. PATENT DOCUMENTS

| | | | | |
|---|---|---|---|---|
| 5,217,177 | A * | 6/1993 | Stefanoni | 242/524.1 |
| 2004/0007642 | A1 * | 1/2004 | Kashima | 242/533.4 |
| 2008/0290206 | A1 | 11/2008 | Matthies | |

FOREIGN PATENT DOCUMENTS

| | | | |
|---|---|---|---|
| DE | 102 23 484 | B4 | 4/2008 |
| GB | 1 159 282 | A | 7/1969 |
| JP | H 4-338066 | | 11/1992 |
| JP | H 7-137942 | | 5/1995 |
| WO | 2008/095982 | A1 | 8/2008 |

OTHER PUBLICATIONS

Japanese Office Action in related, co-pending application No. JP 2013-552897, mailed Jul. 24, 2015 (with English Translation).

* cited by examiner

WINDING MACHINE

CROSS REFERENCE TO RELATED APPLICATIONS

This application is a continuation of International Application PCT/EP2012/051215 with an International Filing Date of Jan. 26, 2012 and claiming priority to co-pending German Patent Application No. DE 10 2011 000 590.0 entitled "Spulmaschine", filed on Feb. 9, 2011.

FIELD OF THE INVENTION

The present invention generally relates to winding machines, wherein a continuously supplied or fed winding material, especially a yarn, a thread, a tape, a ribbon, a wire, a twine etc., is wound in an alternating fashion on two or multiple spindles to a wound package. Further, the invention relates to a method for operating a winding machine of this type.

BACKGROUND OF THE INVENTION

In known winding machines, a winding material is continuously fed from a supply station. For example, the supply station is part of a production line continuously producing the winding material. At the winding machine, the winding material is wound onto a spindle (with or without the use of an intermediate sleeve) such that a wound package is formed. After completion of the winding, it is possible to remove the completely wound package from the winding machine, to transport the wound package and to use the material of the wound package in subsequent processing. The spindle might be driven for effecting the winding motion. Alternatively, the rotational movement of the wound package might be effected by a frictional drive, in particular by a driving roller that is radially pressed at an outer surface of the wound package. During the winding process, the winding material is moved in lateral direction and parallel to the spindle by a traversing device. The traversing device is located in a feeding path of the winding material in a close distance in front of or upstream from the wound package. The rotational and traversing motion are controlled by a control unit such that during the winding process a three dimensional wound package with increasing diameter is formed.

In known winding machines, two or multiple wound packages might be provided, wherein the spindles are transferred in an alternating fashion into a working position wherein the packages are wound. For the winding process of the wound packages, a common traversing device might be provided for both spindles. When in the working position a predetermined amount of the winding material has been wound on the spindle, the spindle is transferred from the working position into a resting position. The continuously fed winding material is then supplied to the other spindle presently set in the working position or to a sleeve supported by the other spindle, respectively. The transfer of the winding material to the other spindle might be performed automatically or might be controlled by an operator. In the resting position, it is possible to manually or automatically remove the completely wound package from the spindle. For transferring the spindles from the working position into the resting position, the spindles are usually rotatably supported by a rotary plate or a turret, wherein the rotational axis of the spindles and of the turret have a parallel orientation. The positions of the spindles are alternately changed by rotation of the rotary plate.

German patent no. DE 102 23 484 B4 relates to the transfer process for the transfer of the winding material from the first to the second spindle. According to the German patent, in advance of the "real" winding process, a fixation winding, a transfer winding or a spare winding is wound outside the fanning width. If the traversing device comprises a reversing screw shaft, it is not possible to move the traversing guide of the traversing device outside the fanning width without taking additional complex measures regarding the design of the groove of the traverse cam. According to the German patent, the traversing device is shifted by a shifting device parallel to the longitudinal and rotational axis of the spindles such that it is possible to feed the winding material to the spindle or sleeve outside the fanning width. The shifting device is a pneumatically actuated piston/cylinder unit which is at any time actuated pneumatically via a valve and an associated control unit. Prior to the removal of the completely wound package from the winding machine, the completely wound package is positioned in the resting position and the empty spindle is positioned in the working position. If (at least in some cases) the completely wound package is not removed from the winding machine before the winding of the other wound package in the working position has been completed, the distance of the spindles has to be larger than the diameter of the completely wound packages in order to ensure that the outer surfaces of the completely wound package in the resting position and the wound package in the working position do not contact or collide. If the distance of the spindles is choosen to be smaller than the diameter of the completely wound packages, the completely wound package in the resting position necessarily has to be removed from the spindle before the winding of the wound package in the working position is completed. Otherwise, the wound packages would collide which might require a shutdown of the complete winding machine. Therefore, with regard to the distance of the two spindles, there is a conflict of objectives since

- on the one hand, a minimization of the distance of the spindles is desired for minimizing the overall size of the winding machine, and
- on the other hand, a large distance between the spindles is desired in order to increase the time interval for the removal of the completely wound packages for decreasing the risk of a collision of the wound packages.

This conflict of objectives gets worse with increasing velocity of the winding process due to the effect that the increase of the velocity of the winding process reduces the time available for a removal of the completely the wound package.

GB 1 159 282 A relates to a winding machine for winding continuously fed winding material in an alternating fashion on two spindles. The spindles are arranged end to end and with a parallel orientation of their longitudinal axes. Each spindle is supported by a swingable arm. It is possible to rotate the arm about an axis having an orientation parallel to the longitudinal axes of the spindles. For winding a wound package, the swingable arm is actuated such that the spindle or the wound package, respectively, is in frictional engagement with a driving roller. When the winding of a wound package is completed, the swingable arm is swung such that the wound package is lifted from the driving roller and transferred into a removal position for removing the completely wound package. After removal of the completely wound package, the swingable arm is swung back for winding another wound package on the spindle.

In the winding machine known from U.S. Pat. No. 3,921,922 A, continuously fed winding material is wound in an alternating fashion on two wound packages being arranged on respective spindles. The spindles are attached to opposite ends of a rotatable arm with their longitudinal axes having a parallel orientation. For a transfer operation, the rotatable arm is rotated about its rotational axis such that a completely wound package on one of the spindles is lifted from the friction drive drum driving the wound package during the winding operation and transferred into a removal position. Concurrently, by the rotation of the rotatable arm an empty tube on the other spindle comes into contact with the friction drive drum such that the winding process on the empty tube starts. In the removal position, the completely wound package is removed from its spindle by a gripping element.

In the winding machines known DE 195 05 838 A1 and WO 2008/095982 A1, two wound packages arranged on respective spindles are wound in an alternating fashion. The spindles are arranged on a rotatable spindle carrier. By rotation of the spindle carrier the spindles can be alternately transferred into an operating position and into a resting position. In the resting position, the completely wound package is shifted off the spindle onto a doffer device. The completely wound package remains on the doffer device until it is manually or automatically removed.

SUMMARY OF THE INVENTION

The present invention relates to a winding machine comprising two spindles for two wound packages arranged thereon. The winding machine further comprises a shifting device. By the shifting device it is possible to shift a completely wound package along its rotational axis into a removal position. In the removal position, the two wound packages are arranged on the spindles without any overlap of their axial extensions. As the wound packages are arranged without any overlap of their axial extensions in the removal position of the completely wound package, the time interval available for removing the completely wound package from its spindle (which is predetermined and depends on a feeding velocity of the winding material) does no longer depend on the distance of the two spindles.

The fact that according to the invention "the two wound packages have no overlap of their axial extensions in the removal position of the completely wound package" does not exclude any overlap of their sleeves. Instead, portions of the sleeves projecting beyond the wound packages might have at least some overlap as long as the wound packages themselves do not have any overlap of their axial extensions. In other words, according to the invention the completely wound package on one spindle and the package being wound on the other spindle axially "bypass" each other such that they are prevented from colliding.

Further, the shifting of the completely wound package by the shifting device might be advantageous with regard to the removal of the completely wound package, since a longer time interval is provided for the removal. Besides, one might take advantage of the fact that the completely wound package is shifted by the shifting device from a main working plane of the winding machine associated with the winding into another plane of the winding machine. In this other plane, the completely wound package might be easier to access, e.g., by an operator or an automatic removing device. Further, the risk of injuries might be decreased. It is also possible that the completely wound package already passes a part of a travel path for the removal towards means for storage or transport of the wound package.

According to one embodiment of the invention, in a winding position of a spindle, a winding material is caught by a spindle or sleeve and/or wound on a spindle or a sleeve supported by the spindle, respectively. This might be realized as known from the prior art. For example, the working position, i.e. the position of the wound package during the winding process, might change during the build-up of the wound package in response to its increasing diameter.

For another embodiment, concurrently with a catching by and/or winding on the spindle located in the working position, a completely wound package located on the other spindle being located in the removal position is removed from the winding machine. The removal might be performed manually by an operator, or (at least a part of) the removal might be automated.

The spindles and/or the wound packages arranged on the spindles, respectively, might be transferred into the working position and the resting position in an alternating fashion. It is also possible that they are temporarily located in other positions, e.g. a holding position or an intermediate position.

By the shifting device it is possible to shift a completely wound package along its rotational axis such that the completely wound package is transferred from a winding position into the removal position. The corresponding shifting path of the shifting device might be larger than the extension of the wound package along its rotational axis and thus, larger than the fanning width of the wound package.

There are various possibilities with regard to the design of the shifting device and with regard to the provision of the necessary shifting path of the completely wound package:

According to one embodiment of the invention, the shifting device shifts the wound package relative to the spindle. The wound package might e.g. be provided with a degree of freedom along its rotational axis relative to the spindle. This degree of freedom might be fixed during the winding process of the wound package, but used by the shifting device for effecting the removal position by shifting the wound package relative to the spindle. In particular, the shifting of the wound package might be a sliding movement along a surface of the spindle.

According to another embodiment of the invention, the shifting device shifts the wound package together with the associated spindle. According to this embodiment, the spindle itself is provided with a degree of freedom relative to the winding machine along its longitudinal or rotational axis. For example, the spindle might be provided with a degree of freedom relative to a rotary plate or a turret, wherein the degree of freedom is used by the shifting device for shifting the wound package into the removal position. Another option is to use a telescopic spindle.

According to an embodiment of the invention, the shifting device is an axial actuator controlled by a control unit. For this embodiment the shifting path of the wound package for effecting the removal position is defined by an actuation path of the axial actuator. The actuator might be a pneumatically actuated piston/cylinder unit with associated valves and an associated electric control unit like generally known from DE 102 23 484 B4 (despite the fact that here it is used in another context). However, the invention is not limited to this particular embodiment—instead, there are also many other options for the design of the shifting device.

For another embodiment of the invention the spindles are moved relatively to a frame fixed to a housing of the winding machine. The spindles move in a plane having an orientation perpendicular to the rotational axes of the spindles or the wound packages from the working position into the resting position (and vice versa). This movement might be provided by a rotation of the rotary plate or the turret (in the following "turret"). For shifting a completely wound package into its removal position, the shifting device shifts the completely wound package along a given shifting path having an orientation parallel to the rotational axis of the wound packages or spindles. The aforementioned two kinds of motions or paths might be controlled separately from each other with regard to the timing. They also might be controlled such that one motion is followed by the other one, wherein the motion of the shifting might be performed before or after the rotation of the turret. If both motions overlap at least partially, a saving of time is achieved even in case of low motion velocities and accelerations.

According to another embodiment of the invention, the shifting device is actuated in dependence on a rotational motion of the turret. For example, the shifting device might be controlled in response to a timing signal by an angle position sensor sensing the rotation of the turret. It is also possible that a switch is provided for the control of the shifting device. The switch is actuated in response to the rotation of the turret. Further, a control signal for rotating the turret might also be used for controlling the shifting device. Alternative to the use of an additional actuator, the motion control of the shifting device by the rotational motion of the turret might be realized by direct coupling of these motions. This might be achieved by a mechanical coupling. For example, a common driving unit might be provided for the turret and the shifting device, wherein the driving power is bifurcated or is divided to the turret and the shifting device, respectively. In another exemplary embodiment, a cam is provided for converting the rotational motion of the turret to the shifting motion. Here, the shifting device with its mechanic coupling is built by the cam.

Regarding those embodiments of the invention wherein the shifting device shifts the completely wound package relative to its axially fixed spindle, the completely wound package might be shifted over a shifting path with a length such that in the removal position the corresponding spindle only partially extends through the completely wound package. The distance of the spindle extending through the completely wound package in the removal position defines the path which has to be passed for removing the wound package from the spindle. This path for removing the completely wound package is reduced in case that in the removal position the spindle only partially extends through the completely wound package. Thus, the effort regarding the removal of the completely wound package might be reduced.

In one embodiment of the invention, the shifting device might be used in a multifunctional manner:

Additional to the transfer of the wound package from the winding position into the removal position, the shifting device might also be used for shifting the wound package into an operating position. Here, in the operating position the winding material extends along a path wherein the winding material interacts with a cutting device and/or a catching device. This operating position might be different from a winding position, a holding position and/or a removal position. For example, for cutting the winding material, the shifting device might push the winding material at a location upstream from the outer surface of the completely wound package against a cutting device, e.g. a cutter. If a catching device is provided, the winding material might be caught in the region of the spindle where a new winding process is initiated.

The shifting device might also shift the wound package into an operating position. In the operating position a fixation winding and/or a transfer winding or a spare winding is wound. This is known for example from DE 102 23 484 B4, wherein according to DE 102 23 484 B4 the traversing device has to be moved for the build-up of a fixation winding, a transfer winding or a spare winding. According to the invention, a similar effect can be achieved by the use of the shifting device, since the winding material is transferred with the shifting of the completely wound package into an axial region of that spindle or sleeve upon which a new package is to be wound. In the aforementioned axial region, it is possible to wind the fixation winding, transfer winding or spare winding.

For a more detailed description regarding the fixation winding, spare winding or transfer winding and the corresponding control measures, it is referred to DE 102 23 484 B4.

Other features and advantages of the present invention will become apparent to one with skill in the art upon examination of the following drawings and the detailed description. It is intended that all such additional features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
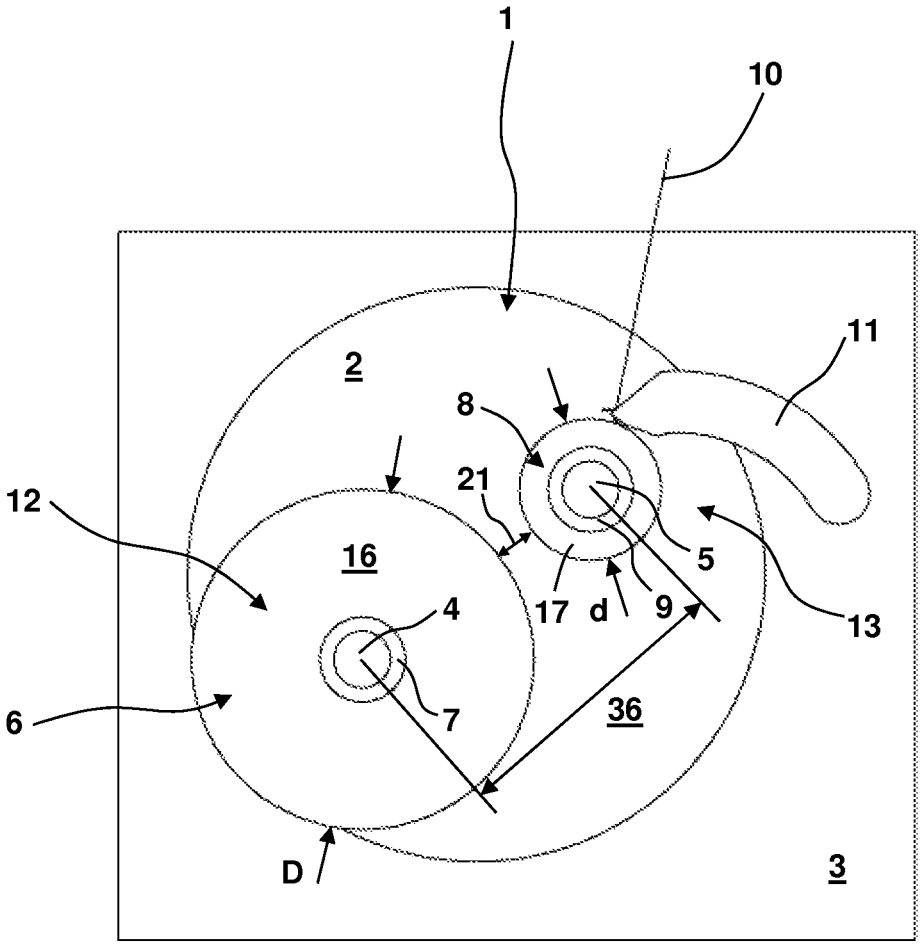
Fig. 1 (Prior Art)
FIG. 1 is a schematic front view of a winding machine known from the prior art.
Figure 2:
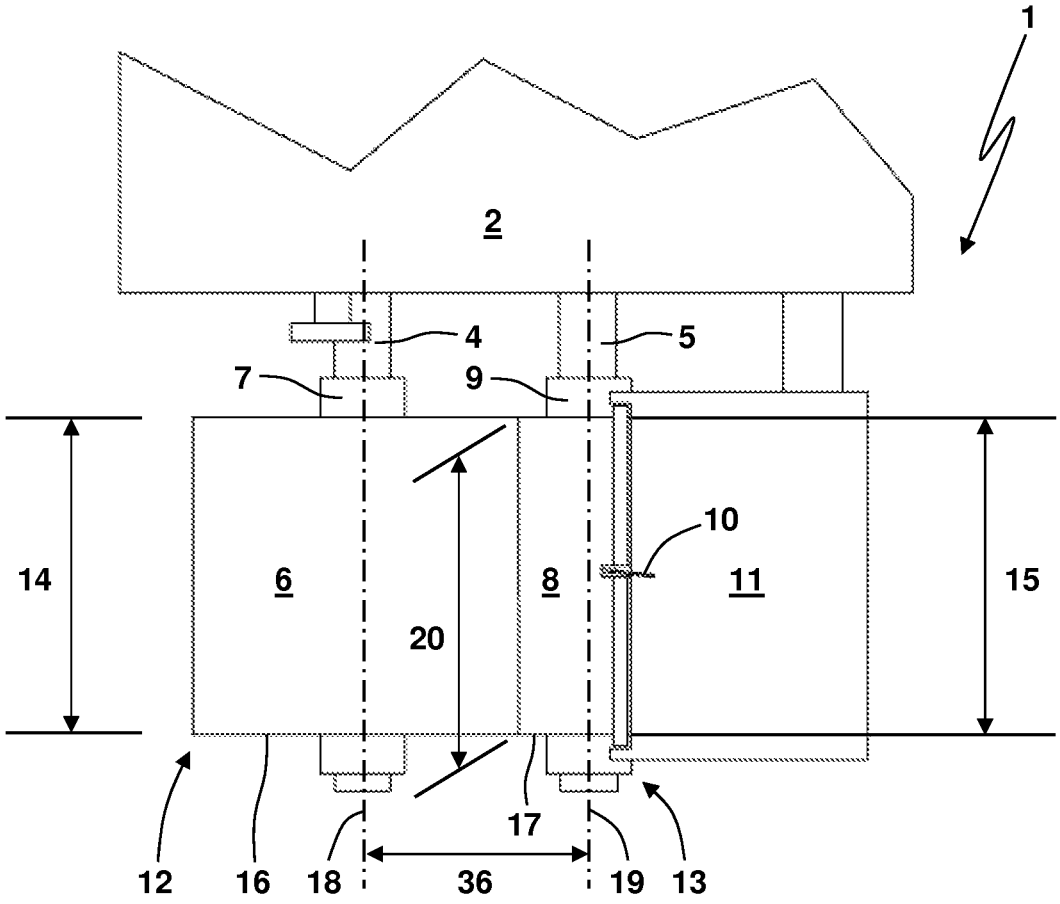
Fig. 2 (Prior Art)
FIG. 2 is a winding machine according to FIG. 1 in a top view.

FIGS. 1 and 2 are schematic views of a winding machine 1. The winding machine 1 comprises a rotary plate or a turret 2. The turret 2 is rotated by an appropriate driving unit relative to a supporting structure 3 of the winding machine 1 about a rotational axis which has an orientation perpendicular to the plane of projection according to FIG. 1. The turret 2 supports spindles 4, 5. The rotational and longitudinal axes 18, 19 of the spindles 4, 5 also have an orientation perpendicular to the plane of projection according to FIG. 1. The rotational and longitudinal axes 18, 19 are located on diametrically opposed sides of the rotational axis of the turret 2. The axes 18, 19 have the same distance from the rotational axis of the turret 2. A completely wound package (preferably with a sleeve 7) is located on the spindle 4. The completely wound package 6 has a diameter D.

On the spindle 5, there is a partially wound package 8 (preferably with a sleeve 9). The wound package 8 has a diameter d increasing to D during the winding process. The winding material 10 is fed to the wound package 8 by a traversing device 11. Like known from prior art, the distance between the traversing 11 and the longitudinal and rotational axis of the spindle 5 might vary during the build-up of the package with increasing diameter d. For this purpose the traversing device 11 or the spindle 5 might be provided with an appropriate degree of freedom in the projection plane of FIG. 1 for a relative displacement. According to FIG. 1, the wound package 6 is located in a resting position 12. In the resting position 12, the wound package 6 has to be removed from the spindle 4 by an operator or in an at least partially automated manner. Further, a new sleeve 7 might be put onto the spindle 4 in the resting position 12. Different from the wound package 6, the wound package 8 is located in a working position 13. In the working position 13, the winding material 10 is caught by the spindle 5 or a sleeve 9. It is possible that a fixation winding and/or a transfer winding or a spare winding is wound. The winding with increasing diameter d is performed. When the winding of the wound package 8 is completed, i.e. when the diameter d of the wound package 8 is equal to the diameter D, the turret 2 is rotated by 180 degrees about its rotational axis. By the rotation of the turret 2, the spindle 5 is transferred into the resting position 12. The spindle 4 (from which the wound package 6 has already been removed) is transferred into the working position 13 such that it is possible to wind a new package on spindle 4.

In FIG. 1, it is shown that a distance 21 between the outer surfaces of the wound packages 6, 8 decreases with increasing diameter d. If no action is taken, at a certain time of the package build-up, the outer surface of the wound package 8 will finally collide with the outer surface of the wound package 6. This would cause an interruption or a stop of the winding process. To prevent such a stop or interruption, the wound package 6 has to be removed from the spindle 4 before the diameter d has increased such that the distance 21 is equal to zero.

FIG. 2 shows that each of the wound packages 6, 8 comprises an axial extension 14, 15. The axial extensions 14, 15 are defined by the fanning width of the winding material and the traversing path of the traversing device 11. Further, FIG. 2 shows that the sleeves 7, 9 project beyond front surfaces of the wound packages 6, 8, i.e. the sleeves 7, 9 have a length which is larger than the axial extensions 14, 15. The front surfaces 16, 17 of the wound packages 6, 8 are located without any offset in the same plane perpendicular to the rotational axis 18, 19 of the wound packages 6, 8. Consequently, the wound packages 6, 8 have an overlap 20, wherein the overlap 20 of the prior art is equal to the axial extensions 14, 15. The spacing 21 of the wound packages 6, 8 is given in a plane comprising the longitudinal axes of the spindles 4, 5. In particular, the axial overlap 20 can be determined by projecting the axial extensions 14, 15 onto a longitudinal or rotational axis 18, 19 of the wound packages 6, 8.

Figure 3:
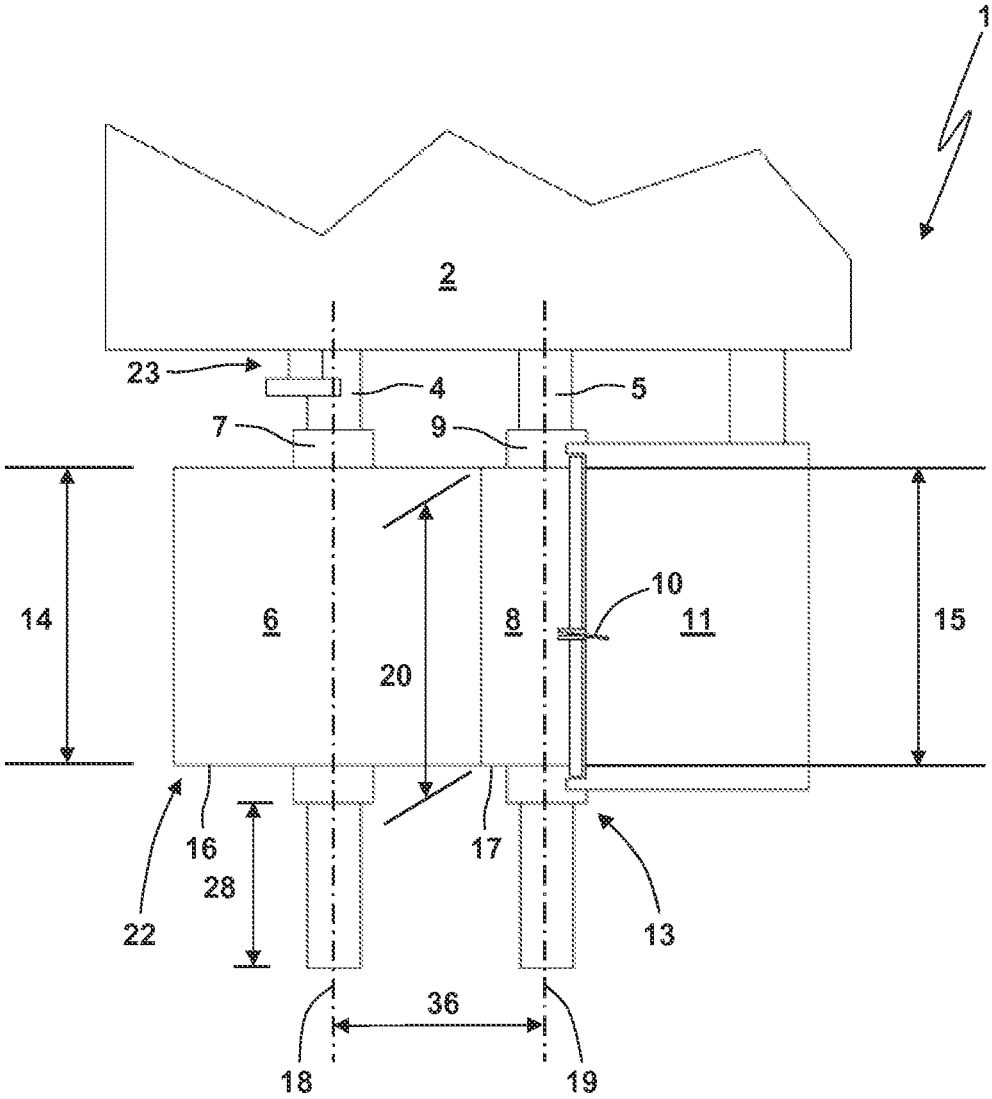
FIG. 3 is a schematic top view of a winding machine according to the invention, wherein a completely wound package is located in an holding position.
Figure 4:
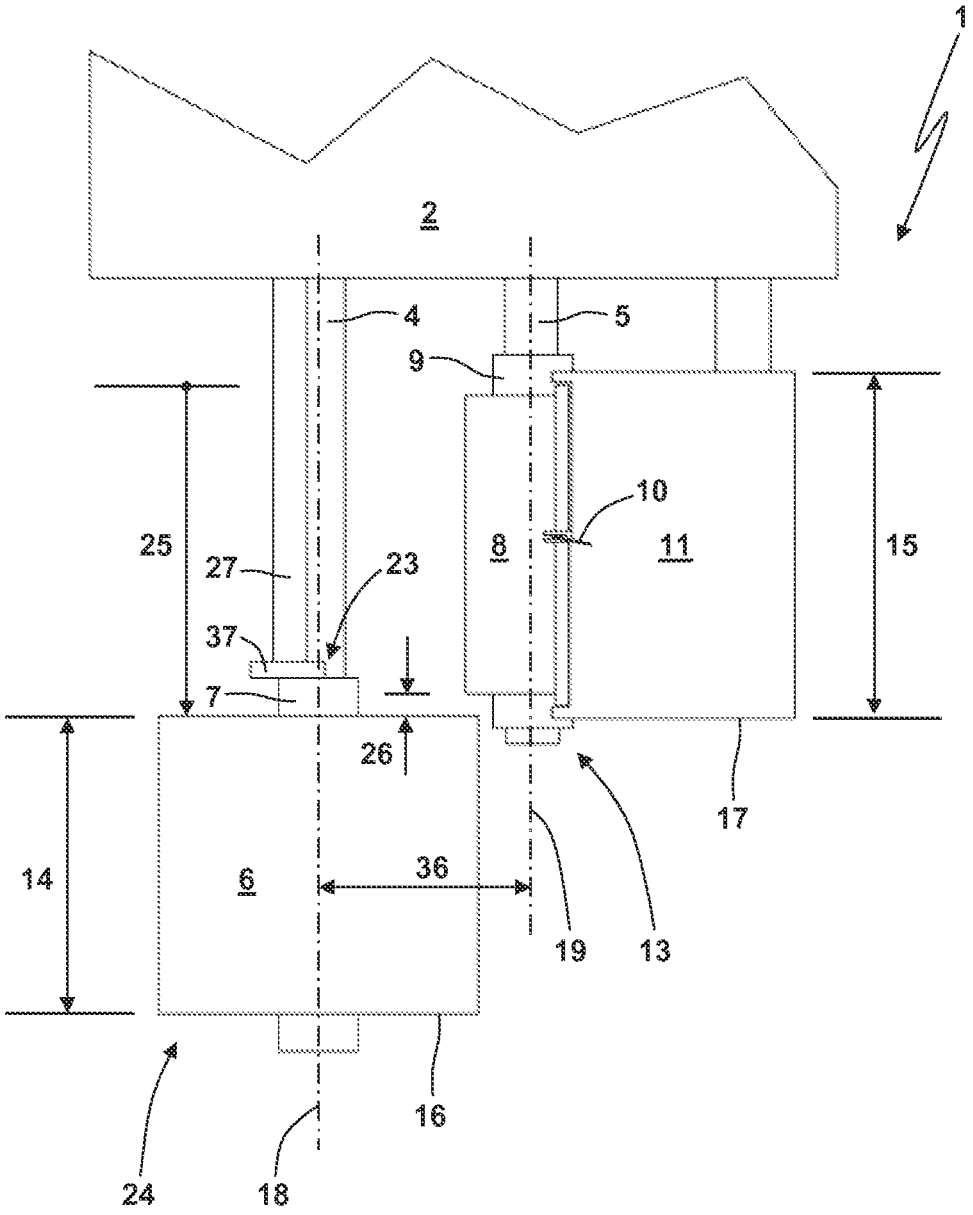
FIG. 4 is a schematic top view of a winding machine according to the invention, wherein a completely wound package is in a removal position.

The front view of a winding machine according to the invention might look like the front view shown in FIG. 1. FIG. 3 shows a schematic top view of an inventive winding machine, wherein the completely wound package 6 is in the resting position 12 and wherein the wound package 8 is in the working position 13 for build-up of the package. Initially, the wound packages 6, 8 have an overlap 20, because both wound packages 6, 8 are in a winding position 22, i.e. both wound packages 6, 8 are located in the same vertical plane. The winding position 22 corresponds to a relative arrangement of the wound packages 6, 8 with regard to the corresponding spindles 4, 5 or with regard to the supporting structure 3 or the turret 2. In the resting position 12 as well as in the winding position 22 of the wound package 6 according to FIG. 3, the completely wound package 6 is not yet removed. Instead, before the spacing 21 of the outer surfaces of the wound packages 6, 8 has reduced to zero due to the increasing diameter d, the completely wound package 6 is transferred by actuation of a shifting device 23 from the winding position 22 into the removal position 24 shown in FIG. 4. By actuation of the shifting device 23 the wound package 6 with sleeve 7 is axially shifted relative to the spindle 4 over a shifting path 25 from the winding position 22 into the removal position 24. The shifting path 25 is chosen such that the axial extensions 14, 15 of the wound packages 6, 8 do not have any overlap 20. Instead, they are arranged at a distance 26 in a projection of the axial extensions 14, 15 onto a longitudinal or rotational axis 18, 19. The shifting path 25 of the shifting device 23 is larger than the axial extensions 14, 15 of the wound packages 6, 8. As shown in FIG. 4, a collision of the wound packages 6, 8 is avoided independent from the diameter d of the wound package 8. It is possible to shift the wound package 6 along the shifting path 25 at any time. For example, the wound package 6 might be shifted at the beginning of the winding process of the wound package 8 or during the package build-up of the wound package 8. It is also possible that the wound package 6 normally is not shifted by the shifting device 23 but normally removed by an operator when being in the winding position 22 according to FIG. 3. For this embodiment also covered by the invention an actuation of the shifting device 23 is only performed in case of an emergency, i.e. in case of an automatic detection that the wound package 6 has not yet been removed from the spindle 4 although the diameter d of the wound package 8 has reached or passed a critical diameter $d_{LIMIT}$. In case of this emergency, the removal position 22 according to FIG. 4 builds a kind of "safety position".

The shifting device 23 shown in FIGS. 3 and 4 comprises a movable push rod 27 controlled by an actuator. For moving the push rod 27, a pneumatic piston/cylinder unit might be used. It is possible that the pneumatic piston/cylinder unit is pneumatically biased against a spring such that with an exhaustion of the pneumatic piston/cylinder unit the push rod 27 is returned by the spring. Furthermore it is possible that, when the piston/cylinder unit is exhausted, the push rod 27 is returned, when a new sleeve 7 is put onto the spindle 4.

According to the embodiment shown in FIG. 4, the front surface of the push rod 27 contacts a front surface of the sleeve 7, e.g. by a contact plate 37, for shifting the wound package 6 along the shifting path 25. It is also possible that a front surface of a respective push rod 27 directly engages the wound package 6, in particular in case the wound package 6 is build without sleeve 7. Further, the wound package 6 or the sleeve 7 might be axially and/or radially fixed on the spindle 4 in the working position 13 as well as during the transfer from the working position 13 to the resting position 12. In the latter case, the axial and/or radial fixation has to be released before an actuation of the shifting device 23.

A comparison of FIGS. 2 and 3 shows that the spindles 4, 5 according to the invention are longer than those according to the prior art: As shown in FIG. 3, in the winding position 22 the spindles 4, 5 project beyond the wound packages 6, 8 (here the sleeves 7, 9) by a length 28. This length 28 is individually chosen. Preferably, the length 28 is about 50 percent to 100 percent of the axial extensions 14, 15 of the wound packages 6, 8. For a minimal length 28 of 50 percent of the axial extensions 14, 15, the wound packages 6, 8 are held in the removal position 24 without tilting. For a small length 28, the path along which the wound package 6 has to be moved along the rotational axis 18 for removal by an operator or in an automatic manner is reduced. The length 28 might be about 60 percent, 70 percent, 80 percent, 90 percent or 100 percent of the axial extension 14, 15. The length 28 might also be longer than the above mentioned lengths.

Figure 5:
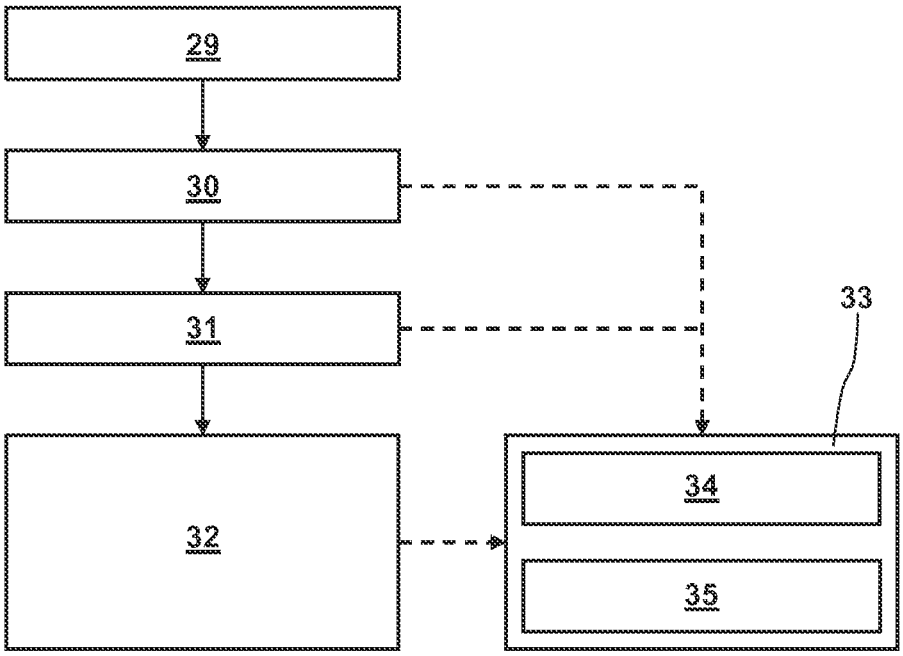
FIG. 5 is a simplified block diagram of an inventive method.

Preferably, the distance 36 of the rotational axis 18, 19, i.e. the longitudinal axes of the spindles 4, 5, which is shown in FIGS. 3 and 5 in a projection, is smaller than the diameter D. The distance 36 of the rotational axis 18, 19 might be about 60 percent, 70 percent, 80 percent, 90 percent or 100 percent of the diameter D. However, the distance of the rotational axes 18, 19 might also be larger than the diameter D. All in all, according to the invention, the available space and the time for handling the completely wound package is increased, and the shifting device 23 might provide a partial execution of the removal.

FIG. 5 shows an exemplary process of an inventive method:

In step 29, the complete winding of the wound package 6 is performed on the spindle 4 located in the working position 13. With regard to the spindle 4, the wound package 6 is in a winding position 22.

In a subsequent step 30, the turret 2 is rotated by an angle of 180 degrees, and the spindle 4 is transferred into a resting position 12 as shown in FIG. 3. Preferably, the wound package 6 remains in the winding position 22 with regard to the spindle 4 during the rotation of the turret 2. In step 31 (which might be executed concurrently with or after step 30), the winding material 10 is fed to the spindle 5 being located in the working position 13 or to the sleeve 9 located on spindle 5. In the working position 13, the winding material 10 might be caught by an appropriate catching device. Further, for a preparation of the winding process, a fixation winding and/or transfer winding or spare winding might be wound.

Finally, in step 31 the winding material 10 is cut.

In a subsequent step 32, the winding material 10 is wound onto the wound package 8 located in the working position, wherein the wound package 8 is located in the winding position 22 with regard to the spindle 5. The wound package 6 on the spindle 4 might be slowed down concurrently with the winding of the wound package 8.

Steps 29 to 32 are equal to the steps during a changing or transfer process in a winding machine 1 known from the prior art.

According to the invention, an additional step 33 is performed. In step 33, the wound package 6 in the resting position 12 is shifted by the shifting device 23 from the winding position 22 into the removal position 24. In the removal position 24 the axial extensions 14, 15 have no overlap 20. Step 33 might include step 34, wherein in step 34, the shifting device 23 is automatically actuated under the control of a control unit of the winding machine 1. In step 35, the wound package 6 is removed from the spindle 4. Here, it is also possible that the wound package 6 has already been partially removed during step 35 with the actuation of the shifting device 23 by movement along the aforementioned length 28. In FIG. 5, different dashed lines indicate that there are various options with regard to the sequence of the steps. In particular, the steps 33, 34 might start at certain times or continue during at least one of the steps 30 to 32. The upper dashed line indicates for example that the actuation of the shifting device 23 in step 34 is performed (at least partially) during the rotation of the turret 2 in step 30. The dashed line in the middle indicates that the actuation of the shifting device 23 might be performed together with a preparation of the winding of the wound package 8, i.e. together with the transfer of the winding material, the winding of the fixation winding, the transfer winding or the spare winding and/or the cutting of the winding material. Furthermore, the partial actuation of the shifting device 23 in step 34 and/or the removal in step 35 might be performed during the winding of the wound package 8.

For each spindle 4, 5 a respective shifting device 23 might be provided. These two shifting devices 23 might be supported by the turret 2, and they might be rotated together with the turret 2. A simplification in construction might be achieved by using a single shifting device 23 for both spindles 4, 5. For example, the shifting device 23 provided for both spindles 4, 5 might be supported by a supporting structure 3 at a position to which the spindles 4, 5 are moved by rotation of the turret 2 for removal of the wound packages.

In case that the shifting device is built with a pneumatically actuated cylinder, the cylinder might be a double acting cylinder for enabling a pneumatic return or reset of the shifting device 23.

The wound packages or sleeves might be fixed on the spindles in a friction locked manner by radially expanding springs surrounding the spindles. The radial expansion of the springs effects that the springs are pressed at the inside at the sleeves so that both a rotary as well as an axial fixation is effected. The springs might be located in V-shaped grooves of the spindles, wherein the V-shaped outline of the grooves builds a wedge like bevel. By spiral springs these springs are pushed along the bevels to the outside, so that the radial expansion is effected. The fixation is pneumatically released by an actor counteracting the force of the spiral springs. Here, the actor might be located immediately below the shifting device 23.

Preferably, the ratio of the diameter D to the distance 36 is about 0.7 to 0.9 and even more preferred about 0.75 to 0.85. For example, the ratio might be 0.80. In terms of the volume that might be wound and thus in terms of the duration before a collision might occur, this ratio means that a collision would occur at about ⅕ of the total package build-up in case that the completely wound package is not removed.

For a non-limiting example the ratio of the distance of the front surface of the spindle 4 from the front surface 16 of the wound package 6 and the axial extension 14 of the completely wound package 6 might be about 0.7 to 0.8, e.g. 0.73. The ratio of the length 28 and the axial extension 14 of the completely wound package 6 might be about 0.6 to 0.7, in particular 0.66. However, other ratios are also possible within the scope of the invention.

Preferably, the shifting device 23 is actuated not until the completely wound package 6 has been completely slowed down by an appropriate braking device. However, it is also possible that the shifting device 23 is actuated at a pint in time wherein the completely wound package 6 is still rotating. In the latter case, it might be advantageously if the shifting device 23 is integrated in the spindle (i.e. if the rotating spindle or a part thereof is axially moved).

Many variations and modifications may be made to the preferred embodiments of the invention without departing substantially from the spirit and principles of the invention. All such modifications and variations are intended to be included herein within the scope of the present invention, as defined by the following claims.

LIST OF REFERENCE NUMERALS 1 winding machine
2 turret
3 supporting structure
4 spindle
5 spindle
6 wound package
7 sleeve
8 wound package
9 sleeve
10 winding material
11 traversing device
12 resting position
13 working position
14 axial extension
15 axial extension
16 front surface

17 front surface
18 rotational axis
19 rotational axis
20 overlap
21 spacing
22 winding position
23 shifting device
24 removal position
25 shifting path
26 distance
27 push rod
28 length
29 step
30 step
31 step
32 step
33 step
34 step
35 step
36 distance
37 contact plate

We claim:

1. A winding machine, comprising a first spindle for a first wound package arranged thereon and a second spindle for a second wound package arranged thereon, and comprising a shifting device for shifting the first and second package, when completely wound, on the first and second spindle one at a time along its rotational axis into a removal position, wherein in the removal position the first and second wound packages are arranged on the first and second spindles without any overlap of each spindle axial extension.

2. The winding machine of claim 1, wherein a) a working position is provided aa) wherein one of the first and second spindles when brought into the working position catches a winding material or winds the winding material and ab) wherein at the same time the respective other of the first and second spindles is located in the resting position and the respective first or second wound package located on the respective first or second spindle, being completely wound, is removed from the winding machine, b) wherein the shifting device shifts the completely wound first or second wound package along its rotational axis on the associated first or second spindle from the winding position into the removal position, c) the shifting device comprises a shifting path which is larger than the axial extension of the first and second wound package along its rotational axis.

3. The winding machine of claim 2, wherein a turret transfers the completely wound first or second wound package from a working position into a resting position by sole rotation of the turret.

4. The winding machine of claim 1, wherein the shifting device shifts the first or second wound package relative to the associated first or second spindle.

5. The winding machine of claim 4, wherein in the removal position of the completely wound first or second wound package, the associated first or second spindle extends only partially through the completely wound first or second wound package.

6. The winding machine of claim 1, wherein the shifting device shifts the first or second wound package together with the associated first and second spindle.

7. Winding machine of claim 1, wherein longitudinal axes of the first and second spindles have a distance which is smaller than a diameter of the completely wound first and second wound packages.

8. The winding machine of claim 1, wherein the shifting device is an axial actuator controlled by a control unit.

9. The winding machine of claim 8, wherein the control unit comprises control logic for actuating the shifting device dependent on a rotational motion of a turret rotatably supporting the first and second spindles.

10. The winding machine of claim 1, wherein the shifting device shifts the first and second wound packages or the first and second spindles into an operating position wherein in the operating position, the winding material extends along a path wherein the winding material interacts with a device selected from the group consisting of a cutting device, a catching device and a combination of a cutting device and a catching device.

11. The winding machine of claim 1, wherein the shifting device shifts the first and second wound packages or the first and second spindles into an operating position, wherein in the operating position a winding formation selected from the group consisting of a fixation winding, a transfer winding, a spare winding and a combination thereof is wound.

12. A method for operating a winding machine for alternately winding a first wound package on a first spindle and a second wound package on a second spindle, wherein the first or second package, when completely wound, is shifted by a shifting device along its rotational axis on its associated first or second spindle into a removal position, wherein in the removal position an axial extension of the first or second wound package is located without any overlap with the axial extension of the other of the first and second wound package being wound on the first or second spindle.

13. The method of claim 12, wherein a) in a working position of the second spindle, a winding material is processed in a processing procedure selected from the group consisting of being caught by the first spindle, being wound onto the first spindle and a combination thereof, b) concurrently with the processing procedure selected according to a), a completely wound first or second wound package located on the associated first or second spindle and located in the removal position is removed from the winding machine, c) the shifting device shifts the completely wound first or second wound package along its rotational axis from a winding position into the removal position, d) the shifting device shifts the completely wound first or second wound package along its rotational axis and along a shifting path, wherein the shifting path is larger than the axial extension of the first and second wound packages.

14. The method of claim 13, wherein the completely wound first and second wound packages are transferred from a working position into a resting position by a rotation of a turret.

15. The method of claim 12, wherein the completely wound first and second wound packages are shifted relative to the first and second spindles by the shifting device.

16. The method of claim 15, wherein in the removal position, the first or second spindle extends only partially through the completely wound first or second wound package.

17. The method of claim 12, wherein the completely wound first and second wound packages are shifted together with the associated first and second spindle by the shifting device.

18. The method of claim 12, wherein longitudinal axes of the first and second spindles have a distance which is smaller than a diameter of the completely wound first and second wound package.

19. The method of claim 12, wherein an axial actuator is used as the shifting device, wherein the axial actuator is controlled by a control unit.

20. The method of claim 19, wherein the shifting device is actuated by the control unit dependent on a rotational motion of a turret rotatably supporting the first and second spindles.

21. The method of claim 12, wherein the shifting device shifts the first and second wound packages or the first and second spindles into an operating position, wherein in the operating position the winding material extends along a path wherein the winding material interacts with a device selected from the group consisting of a cutting device, a catching device and a combination thereof.

22. The method of claim 12, wherein the shifting device shifts the first and second wound packages or the first and second spindles into an operating position, wherein in the operating position the winding of a winding formation selected from the group consisting of a fixation winding, a transfer winding, a spare winding and a combination thereof is performed.

* * * * *